US006141916A

United States Patent [19]

Shackelford

[11] Patent Number: 6,141,916

[45] Date of Patent: Nov. 7, 2000

[54] SURFACE DRAIN SYSTEM

[75] Inventor: George W. Shackelford, Murrietta, Calif.

[73] Assignee: Turf Tek Products, Inc., Riverside, Calif.

[21] Appl. No.: 09/192,013

[22] Filed: Nov. 13, 1998

[51] Int. Cl.[7] ..... E04D 13/076

[52] U.S. Cl. ..... 52/12; 52/11; 52/16; 210/163

[58] Field of Search ..... 52/11, 12, 14, 52/16, 169.5; 210/163, 164, 165, 166, 474, 455; 404/2, 4

[56] References Cited

U.S. PATENT DOCUMENTS

| | | | |
|---|---|---|---|
| 803,316 | 10/1905 | Vogel | 52/16 X |
| 2,640,593 | 6/1953 | Korb | 52/12 X |
| 2,701,027 | 2/1955 | Scoville | 210/163 |
| 4,216,790 | 8/1980 | Stolz | 52/12 X |
| 4,272,370 | 6/1981 | Cunning | 52/12 X |
| 5,181,793 | 1/1993 | Dekel | 52/11 X |
| 5,409,602 | 4/1995 | Sorenson | 52/12 X |
| 5,529,436 | 6/1996 | Meyers | 404/4 X |
| 5,535,554 | 7/1996 | Harris, Jr. | 52/12 |

FOREIGN PATENT DOCUMENTS

| | | | |
|---|---|---|---|
| 3928450 | 3/1991 | Germany | 52/14 |
| 4-140355 | 5/1992 | Japan | 52/11 |
| 4-347249 | 12/1992 | Japan | 52/11 |
| 6-117065 | 4/1994 | Japan | 52/12 |
| 302511 | 7/1968 | Sweden | 52/12 |
| 841369 | 7/1960 | United Kingdom | 52/11 |
| 1472575 | 5/1977 | United Kingdom | 52/16 |

*Primary Examiner*—Laura A. Callo
*Attorney, Agent, or Firm*—Donald D. Mon

[57] ABSTRACT

A drain channel having a bottom and two sidewalls. A domed strainer is attached to the bottom surrounding a drain port, spaced from both sidewalls. A rigid brace is rigidly attached to both sidewalls and to the dome. It has apertures which will pass water to all sides of the domed strainer, and provides mutual reinforcement of the strainer and the sidewalls. If desired a trough can be telescopically fitted to the drain channel.

3 Claims, 2 Drawing Sheets

SURFACE DRAIN SYSTEM

FIELD OF THE INVENTION

A readily assembled system for draining the surface of an area such as a driveway or a roof.

BACKGROUND OF THE INVENTION

Drains for collecting runoff water from surfaces such as driveways and roofs edges are known. They present a trough placed at or below grade level, and some kind of outlet to pass collected water from the trough to a disposal means such as a gutter, storm drain, or sewer. Because their installation is almost always a custom arrangement, known systems generally cost more, including installation, than if they could be fabricated from simple elements chosen for function and readily cut to length and assembled without requiring secondary operations such as soldering or crimping. The costs of installation, parts, and repairs to such systems are importantly reduced by this invention.

In addition, force loads on the walls of the trough may undesirably distort the elements. A bracing which involves least impediment to outflow is desirable to provide structural integrity to portions of the system which are exposed to larger forces.

BRIEF DESCRIPTION OF THE INVENTION

A surface drain system according to this invention includes a trough segment and a drain segment. The trough section comprises a rigid, axially extending trough which has a bottom, a pair of opposite sides, and an open top. A grating rests on the open top to screen out larger pieces of debris. The trough segment has a uniform lateral cross-section.

The drain segment comprises a rigid, axially extending trough which has a bottom, a pair of opposite sides and an open top. It has a uniform cross-section whose dimensions are sufficiently different from those of the trough section that the sections can be telescoped together to form a continuous channel that is substantially closed against leakage at their overlap.

According to a feature of this invention, an outlet port is formed in the bottom of the drain segment, and a strainer dome is attached to its bottom to surround the outlet port. The dome is pierced with passages that are dimensioned to retain larger pieces of debris that should not pass through them and clog a downstream system. An internal brace between the strainer dome and the walls mutually laterally supports the strainer dome and the walls relative to each other at a point where the trough is likeliest to be subjected to a maximum separative force.

DETAILED DESCRIPTION OF THE INVENTION

Figure 1:
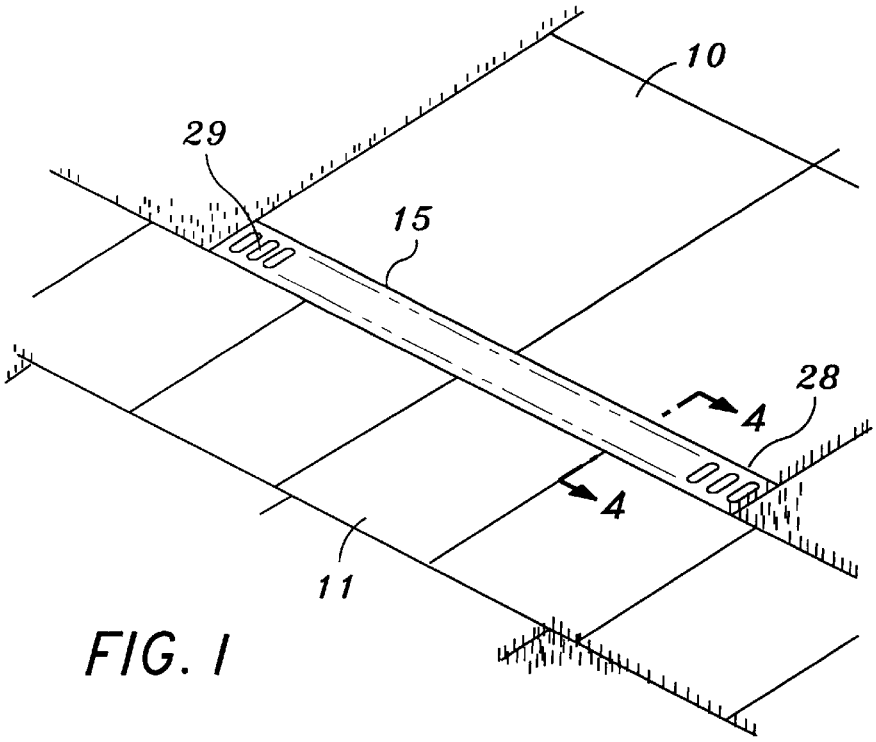
FIG. 1 is a perspective view of the abutment of a driveway and a sidewalk with a system according to the invention between them.
Figure 2:
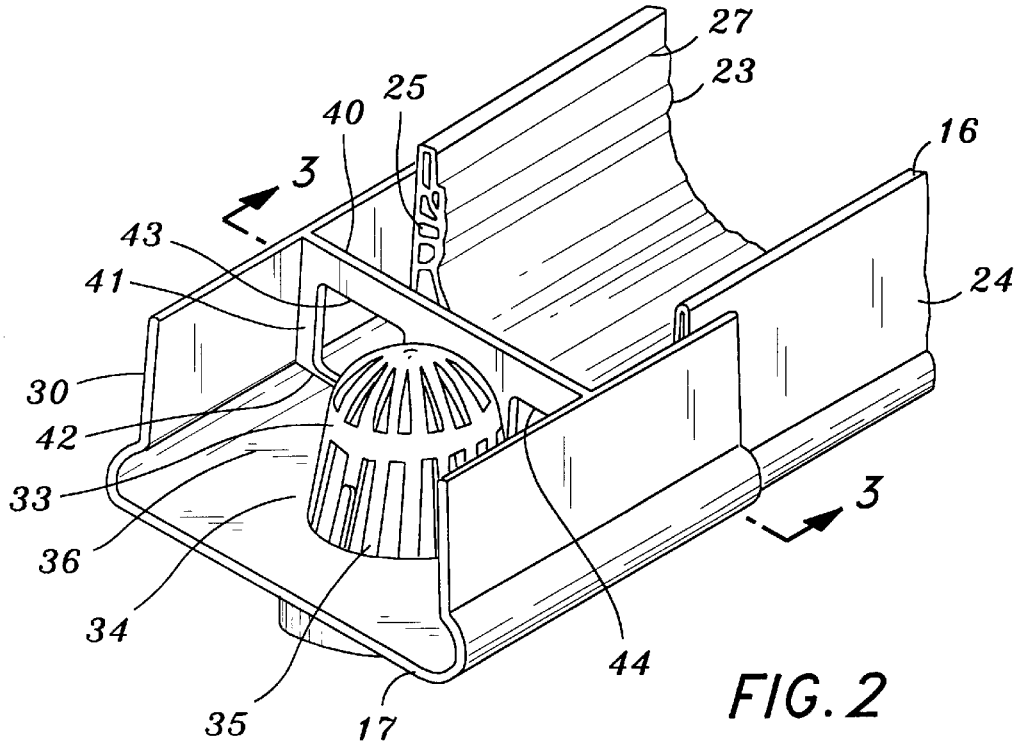
FIG. 2 is a perspective view of parts of the system of FIG. 1.
Figure 3:
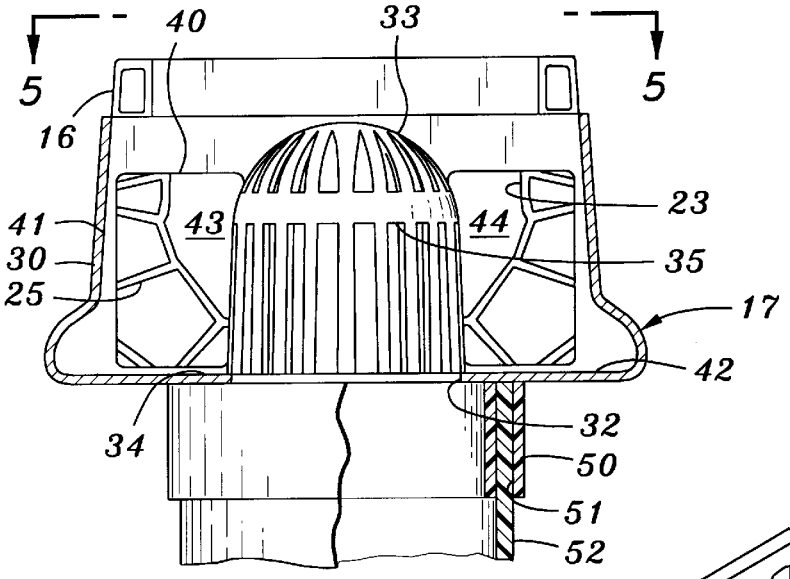
FIG. 3 is a view principally taken in cross-section at line 3—3 in FIG. 2.
Figure 5:
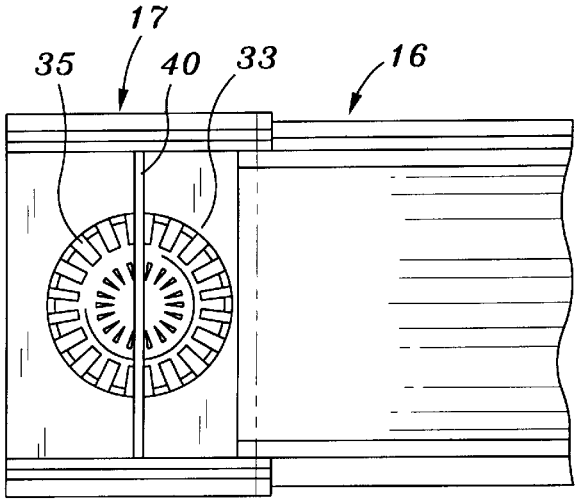
FIG. 5 is a top view of FIG. 3 taken at line 5—5 in FIG. 3.

A use for this invention is shown in FIG. 1, where a driveway 10 and a sidewalk 11 abut. It is the object of this invention to provide drainage of surface water flow from the driveway before it reaches the sidewalk. For this purpose, as shown in FIGS. 1 and 5, a drainage system 15 according to this invention is sunk into the ground so its upper surface is at or just below grade. Should this system be used for installations such as roof-edge gutters, it will be attached to adjoining structure instead of being submerged. Its functions and advantages are identical in either event.

Such a system includes at least one trough segment 16 and one drain segment 17. The lateral cross-section dimensions of these segments are such that the inside wall of one will telescopically receive the outside wall of the other. Thus, a system of trough segments and drain segments can be assembled of any desired length. Should two trough segments directly abut, then a joinder segment with lateral dimensions similar to those of the drain segment will be provided to telescope between the two adjacent trough segments and form a continuous channel.

It is an advantage of this invention that its parts can be made from moldings or continuous extrusions. This enables the use of strong long-lived organic plastic materials such as polypropylene, or other strong plastic materials, perhaps reinforced with fibers such as glass fibers.

Figure 4:
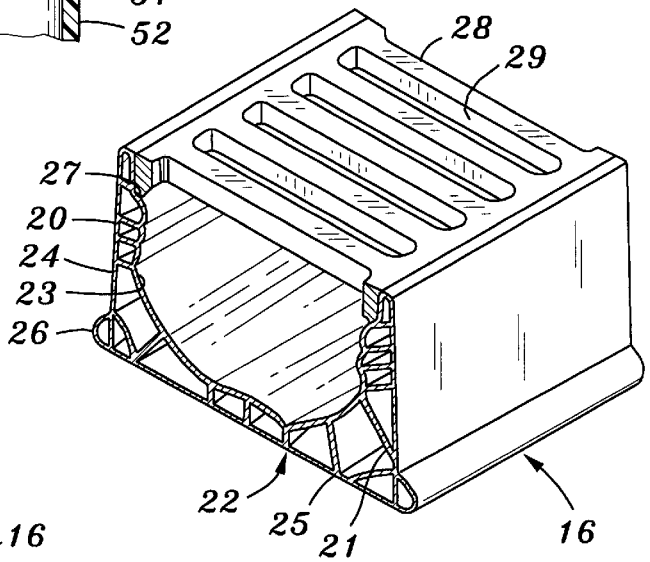
FIG. 4 is a view principally taken in cross-section at line 4—4 in FIG. 1.

A useful configuration for the trough segments is shown in FIG. 4, where sidewalls 20, 21 and bottom 22 are formed as double wall structures with an internal wall 23 and an external wall 24. Longitudinally extending webs 25 join and support the walls relative to each other. This provides great strength to the structure, while significantly lightening its weight.

Feet 26 and a grate shoulder 27 extend longitudinally along the trough segment. The feet provide greater stability and retention in the earth or concrete in which the shoulder is set.

Grate shoulders 27 support a grate 28 that rests on them. The grate is a rigid plate with slots 29 to pass water and screen out larger pieces of trash such as leaves. These can be swept away and gathered separately so they do not plug up the system.

The drain segment 17 has a generally similar wall 30 which may have greater or lesser dimensions than the trough's inside or outside walls, so they can telescope. Somewhere between its ends, a port 32 has been cut, and a dome-like strainer 33 has been fixed to the bottom 34, such as by gluing or cementing. The strainer has slots 35 that are smaller than slots 29 in the grate. The inside of the strainer opens to the port. The outside of the strainer is located in the channel 36 formed by the inner wall.

The location of the strainer is where there will be a maximum accumulation of water and debris, and therefore where there is the greatest likelihood of structural failure or cracking. To reduce this risk, a brace 40 is molded as an integral part of the strainer, extending radially across it at its center, and forming edges 41, 42 that are glued or otherwise fixed to the inside wall and to the bottom. Apertures 43, 44 are formed in these braces to enable flow past them so that all sides of the dome are available for drainage from both directions. This construction is rigid and open to flow. The brace provides additional support for the grate.

A drain stub 50 is glued or otherwise fixed to the outside of the bottom of the drain segment. It has a circular groove 51 to receive the end of a pipe 52 such as a downspout or a drain pipe that leads to a gutter, which may be cemented in place or simply be press-fit into groove 51.

This is a simple and rugged construction. It can readily be assembled by sliding adjacent segments together and connecting the drain stub to any desired pipe. The segments can be cut to any desired dimension, and enable a nearly limitless array to suit the requirements of the installation.

This invention is not to be limited by the embodiments shown in the drawings and described in the description, which are given by way of example and not of limitation, but only in accordance with the scope of the appended claims.

I claim:

1. A drain system for drainage of an adjacent area comprising:

a trough segment comprising an integral body with a longitudinal axis, and having a bottom and a pair of spaced apart sidewalls, each said sidewall having an inside wall and an outside wall spaced from each other and joined to one another by a group of longitudinally-extending webs, said inside wall forming a shoulder; and a drain segment comprising an integral body with a longitudinal axis and having a bottom wall and a pair of spaced-apart sidewalls, a port through said bottom wall, a strainer having a domed wall, an internal cavity, an opening edge from said cavity having an edge and a plurality of perforations through said domed wall, said strainer at said edge of said domed wall being rigidly and fixedly attached to said bottom wall around said port and spaced from the adjacent sidewalls, a rigid brace extending between and fixed to said sidewalls of said drain segment and to said domed wall mutually to support said sidewalls and domed wall relative to one another, said brace having apertures therethrough to pass water to both sides of said domed wall, said trough segment and said drain segment being so proportioned and arranged as to be telescopically joined together at respective ends.

2. A drain system according to claim 1 in which a stub is fixed to the outside of said bottom wall surrounding said port to enable attachment for a pipe thereto.

3. A drain segment comprising an integral body with a longitudinal axis and having a bottom wall and a pair of spaced-apart sidewalls, a port through said bottom wall, a strainer having a domed wall, an internal cavity, an opening from said cavity having an edge and a plurality of perforations through said domed wall, said strainer at said edge of said domed wall being rigidly and fixedly attached to said bottom wall around said port and spaced from the adjacent sidewalls, a rigid brace extending between and fixed to said sidewalls and to said domed wall mutually to support said sidewalls and domed wall relative to one another, said brace having apertures therethrough to pass water to both sides of said domed wall.

* * * * *